US005862983A

United States Patent [19]

Andrus et al.

[11] Patent Number: 5,862,983

[45] Date of Patent: Jan. 26, 1999

[54] VEHICLE WHEEL TRACTION APPARATUS

[76] Inventors: Clair P. Andrus; Richard P. Hubbard, both of Porter-Prescott, 4050 24th St., San Francisco, Calif. 94114

[21] Appl. No.: 878,469

[22] Filed: Jun. 18, 1997

Related U.S. Application Data

[60] Provisional application No. 60/020,214, Jun. 21, 1996.

[51] Int. Cl.[6] ..... E01B 23/00

[52] U.S. Cl. ..... 238/14

[58] Field of Search ..... 238/14; 152/208; 180/9, 9.1, 9.21, 9.26, 9.3, 9.34, 9.62; 403/52, 220, 345, 381

[56] References Cited

U.S. PATENT DOCUMENTS

| | | | |
|---|---|---|---|
| 1,370,905 | 3/1921 | Newdick | 238/14 |
| 1,574,729 | 2/1926 | Foster | 238/14 |
| 1,732,975 | 10/1929 | Lindner | 238/14 |
| 4,261,510 | 4/1981 | Andrus . | |
| 4,681,482 | 7/1987 | Arciszewski et al. | 238/14 |
| 5,100,054 | 3/1992 | Fickett et al. | 238/14 |
| 5,402,941 | 4/1995 | Macleod | 238/14 |
| 5,439,171 | 8/1995 | Fruend | 238/14 |

FOREIGN PATENT DOCUMENTS

| | | | |
|---|---|---|---|
| 548783 | 6/1993 | European Pat. Off. | 238/14 |

*Primary Examiner*—Mark Tuan Le
*Attorney, Agent, or Firm*—Douglas E. White

[57] ABSTRACT

An improved vehicle wheel traction apparatus comprises a plurality of barred traction plates which, when not interconnected, may be stacked together in a compact form for stowage. It includes means for interlocking the plurality of barred plates together to form a single loosely-articulated apparatus which automatically conforms in general profile to the profile of the rut in which the vehicle wheel is confined. The apparatus may be made as long as desired simply by interconnecting more individual plates. Because the combined apparatus rotates at articulated joints to conform to the rut, it is not subject to fracture from the weight of the car or other vehicle.

13 Claims, 2 Drawing Sheets

VEHICLE WHEEL TRACTION APPARATUS

CROSS REFERENCE TO RELATED APPLICATIONS

This application claims the benefit of U.S. Provisional Application No. 60/020,214, filed Jun. 21, 1996.

FIELD OF THE INVENTION

This invention relates to traction devices, more particularly, to a traction plate adapted to be gripped by a motor vehicle wheel and, in turn, to grip itself to a slippery surface. The traction plate device interlocks with similar plates to provide an elongated vehicle wheel traction apparatus which flexes at the interlocking joints.

BACKGROUND OF THE INVENTION

In many regions, depending on geological and meteorological conditions, the likelihood exits that motor vehicles will encounter situations where the driving wheels thereof become embedded in snow, mud, sand, or the like. The traction required for moving the vehicle may become greater than the drive wheels can create. The result often is that the vehicle ceases to progress forward. Thereafter, repeated attempts to move the vehicle forward or backward causes ruts of irregular configuration to form, and the vehicle to become entrapped therein.

Attempts to extract the vehicle by using inflexible fixed-length planar surfaces, such as (in the most primitive form) wooden boards, are often ineffectual. First of all, it may be difficult to get a sufficiently long board both into the rut and under the tire. Secondly, the planar board or the like needs to be placed with one end under the tire and the other end out of the rut. However, this can cause the planar traction device to be angled upward to a degree (depending on the depth of the rut) which itself prevents the wheel from gaining increased traction. Finally, if the vehicle is backed up to the rear of the rut so that an inflexible traction device can be inserted under it at a low angle, driving forward can cause the traction device to collapse in its unsupported middle under the weight of the car.

In such situations, it can be important for a stranded motorist to have available means for extracting the vehicle without outside assistance. A suitable traction apparatus needs to be compact, lightweight, durable, and configured for ready application in ruts of varying depth and profiles.

Prior developments in this field may be generally illustrated by reference to U.S. Pat. No. 4,261,510, which describes a vehicle wheel traction device comprising an elongated body plate of a width somewhat greater than the width of the vehicle tire with which the device is used. The stated length of the device is 22 inches. Fastened transversely and in spaced relationship along the length of the plate are a plurality of bars or beams constituting a gripping surface for the wheel, and, on the reverse side of the plate, a plurality of similarly shaped but diametrically-opposed bars. The latter bars are for gripping the soft material (snow, mud, sand, and the like) simultaneously as the wheel is driven along the traction device over the soft material from which the embedded wheel is to be dislodged. The teachings of this patent are hereby wholly incorporated by reference herein.

The device of U.S. Pat. No. 4,261,510, while providing many good qualities, has been found to suffer the disadvantages common to inflexible fixed-length devices as described above. Namely, if the device is made in a length adequate to allow the vehicle to build up momentum, as taught in said patent, it may be difficult to put in place, especially at a proper angle; it may be bent or broken by the weight of the car; and it takes up excessive room in a car trunk.

SUMMARY OF THE INVENTION

The present invention is an improvement on the general type of barred traction plate taught in U.S. Pat. No. 4,261,510. It is short enough that a plurality of barred plates may be stacked together in a compact form for stowage. It includes means for combining or interlocking the plurality of barred plates to form a single loosely-articulated vehicle wheel traction apparatus which automatically conforms in general shape to the profile of the rut in which the vehicle wheel is confined. The apparatus may be made as long as desired simply by interconnecting more individual plates. Because the combined apparatus rotates at articulated joints to conform somewhat to the rut, it is not subject to fracture from the weight of the car after being forced to be bridged out over empty space.

FEATURES AND ADVANTAGES

An object of this invention is to disclose vehicle wheel traction plate apparatus including a planar elongated body plate; a plurality of transverse gripping beams attached to the upper surface and lower surface of the body plate; and means for interlocking a plurality of body plates together.

A further object or feature is that the interlocking means includes a hinge member on at least one end of the body plate. Preferably, the interlocking means includes first and second hinge members, one on each of two opposite ends of the body plate.

Yet another feature is a transverse cylindrical bead on the first hinge member and a transverse open-sided cylindrical channel formed on the second hinge member, the channel being generally congruent in shape and diameter to the cylindrical bead.

Still another feature is the open side of the channel forms an arcuate gap of from 20 to 40 degrees in extent (preferably 30 degrees).

Another preferred feature is a gripping beam on the cylindrical bead.

Yet another feature is top surfaces on the free distal ends of the gripping beams, the top surfaces all lying in a plane that is parallel to the plane of the body plate.

As another feature, the gripping beams are planar, each of whose planes intersect the plane of the body plate at an angle of from 55 to 75 degrees (preferably 65 degrees).

Another object is to disclose vehicle wheel traction apparatus including a plurality of planar elongated body plates; a plurality of inclined transverse gripping beams attached to the upper surface and lower surface of each body plate; and hinge means for interlocking the plurality of body plates together.

A feature of the invention is that the length of individual traction plates may be shortened (in comparison to prior art plates), to make compact stacking and storage possible, while allowing the effective length of the traction apparatus as a whole to be increased.

Another feature is an apparatus that is easy to use, attractive in appearance and suitable for mass production at relatively low cost.

Other novel features which are characteristic of the invention, as to organization and method of operation, together with further objects and advantages thereof will be better understood from the following description considered in connection with the accompanying drawing, in which a preferred embodiment of the invention is illustrated by way of example. It is to be expressly understood, however, that the drawing is for illustration and description only and is not intended as a definition of the limits of the invention.

Certain terminology and derivations thereof may be used in the following description for convenience in reference only, and will not be limiting. For example, words such as "upwardly," "downwardly," "leftward," and "rightward" would refer to directions in the drawings to which reference is made unless otherwise stated. Similarly, words such as "inwardly" and "outwardly" would refer to directions toward and away from, respectively, the geometric center of a device or area and designated parts thereof References in the singular tense include the plural, and vice versa, unless otherwise noted.

DRAWING REFERENCE NUMERALS

Figure 1:
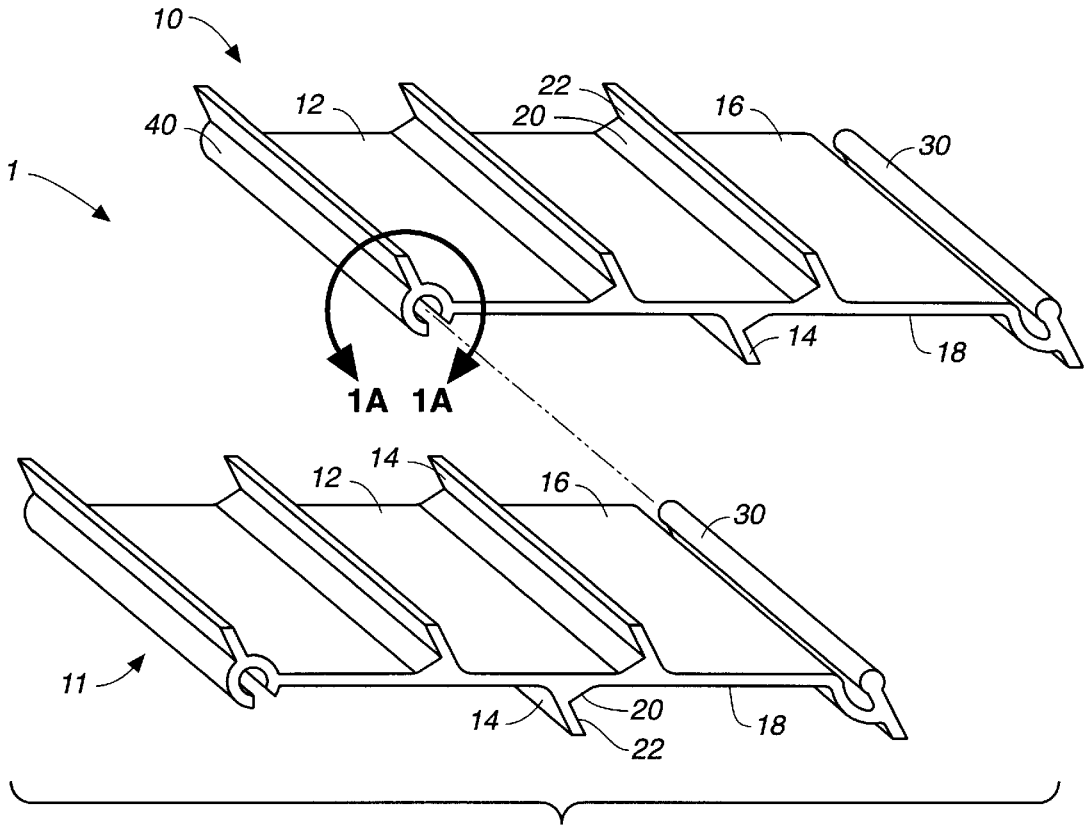
FIG. 1 is an exploded perspective view of a preferred vehicle wheel traction apparatus of this invention.

1 traction apparatus
10 traction plate
11 traction plate
11A traction plate
12 elongated body plate
13 rut
14 traction bar
16 upper surface
18 lower surface
20 support member
22 gripping beam
22*a* gripping beam
22*b* gripping beam
23 top surface
24 neck
30 male hinge end
31 cylindrical bead member
32 arcuate support member
34 hollow
40 female hinge end
41 cylindrical channel member
42 hollow
44 arcuate support member
46 arcuate free leg
50 vehicle
52 wheel
A angle
B angle of rotation
C angle
D angle
G gap

Description of a Preferred Embodiment

Referring to FIG. 1, there is illustrated therein a vehicle wheel traction apparatus 1. Traction apparatus 1 is comprised of a plurality of barred traction plates. In FIG. 1, two such plate devices are shown, namely, traction plate device 10 and traction plate device 11. It is to be understood, however, that a traction apparatus 1 may be comprised of any suitable number of barred traction plates chained together, as explained in more detail below.

FIGS. 2 and 2A–C are a series of elevational views revealing details of the construction of an exemplary traction plate device 10. The traction plate device 11 is an exact duplicate of the traction plate device 10, as are, preferably, all others comprising an assembled traction apparatus 1. However, it may be desirable, for example, to eliminate a male end 30 or female end 40 on one or more plate devices of a set to provide a smooth leading edge to freely insert under a tire (not illustrated).

Each traction plate device 10, 11, etc., is comprised of an elongated body plate 12 having a spaced plurality of parallel transverse traction bars 14 disposed on its upper surface 16 and on its lower surface 18. The traction bars 14 are each comprised of an angled gripping beam 22 and a fillet or support member 20, which beam is supported against longitudinal thrust by the support member 20.

The above features of barred traction plates are known in the art. For a further discussion of these standard features, as to mode of operation and the like, see U.S. Pat. No. 4,261,510, above.

The present invention comprises improvements in barred traction plates which enable them to form a chained traction apparatus 1, as follows. The longitudinal ends, namely, male end 30 and female end 40, of elongated body plate 12 are modified to incorporate interlocking, rotatable, freely releasable hinge members.

Figure 2A:
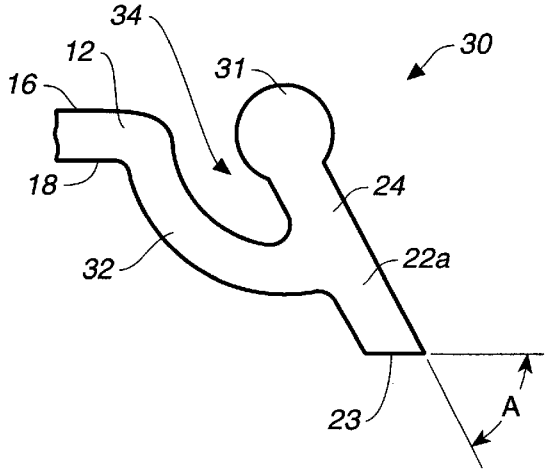
FIG. 2A is a broken detail view of the male end of the traction plate device of FIG. 2.

Turning to FIG. 2A, a male end 30 is comprised of a transversely-extending cylindrical male hinge or bead member 31, molded or otherwise affixed to the inward or proximal end of an otherwise conventional gripping beam 22*a*. An arcuate support member 32 connects the gripping beam 22*a* to the elongated body plate 12 parallel to and at the same angle A with the horizontal as the other gripping beams 22. Angle A is about 65°, plus or minus 10° (from 55° to 75°). The top surface 23 of the gripping beam 22*a* terminates in the same horizontal plane as the top surfaces 23 of the remaining gripping beams 22. The arcuate support member 32 forms a radially-curved hollow 34 between itself and the neck 24 of the beaded gripping beam 22*a*.

Figure 2B:
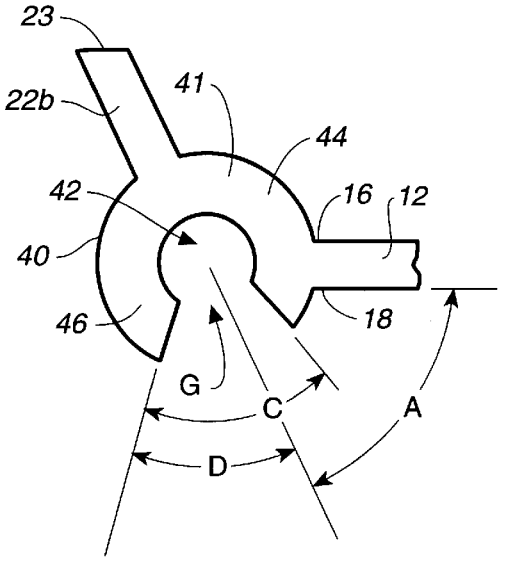
FIG. 2B is a broken detail view of the female end of the traction plate device of FIG. 2.
Figure 2C:
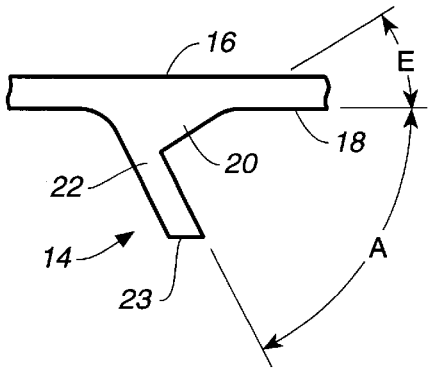
FIG. 2C is a broken rear view of a bottom traction bar of the traction plate device of FIG. 2.

At the opposite end of the elongated body plate 12 is formed the female end 40 (FIG. 2B, which includes a transversely-extending cylindrical female hinge or channel member 41. Attached to member 41 is an upwardly extending gripping beam 22*b* that is oriented at the same angle A as the other gripping beams 22. The top surface 23 of the gripping beam 22*b* terminates in the same horizontal plane as the top surfaces 23 of the remaining gripping beams 22. Preferably, the planes of all top surfaces 23 are formed parallel to the plane of the elongated body plate 12, rather than canted downward as taught in the art, so as to reduce the possibility of wear and damage to the vehicle tire.

The cylindrical channel member 41 is comprised of an arcuate support member 44 that connects the proximal side of the gripping beam 22*b* to the elongated body plate 12 and, on the distal side of the gripping beam 22*b*, is comprised of an arcuate free leg 46.

The cylindrical channel member 41 forms an open-sided hollow or channel 42 that is generally congruent in shape and diameter to the cylindrical bead member 31 of the male end 30. A gap G is formed in about the lower proximal quadrant of the cylindrical channel member 41. Gap G provides access to the hollow 42 for the bead 31 of an adjacent traction plate.

To interconnect any two plate devices, such as traction plate devices 10, 11 (FIGS. 1 and 1A), the cylindrical bead or first hinge member 31 of the male end 30 of one (e.g., traction plate device 11) is inserted from the side into the channel 42 of the other (e.g., traction plate device 10) and laterally threaded inward. The neck 24 of the terminal gripping beam 22*a* extends down and out of the gap G in the cylindrical channel member 41. The arcuate free leg 46 of the cylindrical channel or second hinge member 41 of the female end 40 fits into the congruently-shaped hollow 34 of the male end 30.

Chaining a series of traction plates together in this manner allows a traction apparatus 1 to have an effective length that is significantly greater than heretofore available in the art. At the same time, the apparatus 1 is made of traction plate segments 10, 11, 11A whose individual length is able to be much less than prior art devices, yet to remain effective for the intended purpose. The preferred length of each of the traction plate devices 10, 11, A is under 7 inches—less than ⅓ the length of the device of U.S. Pat. No. 4,261,510.

Figure 3:
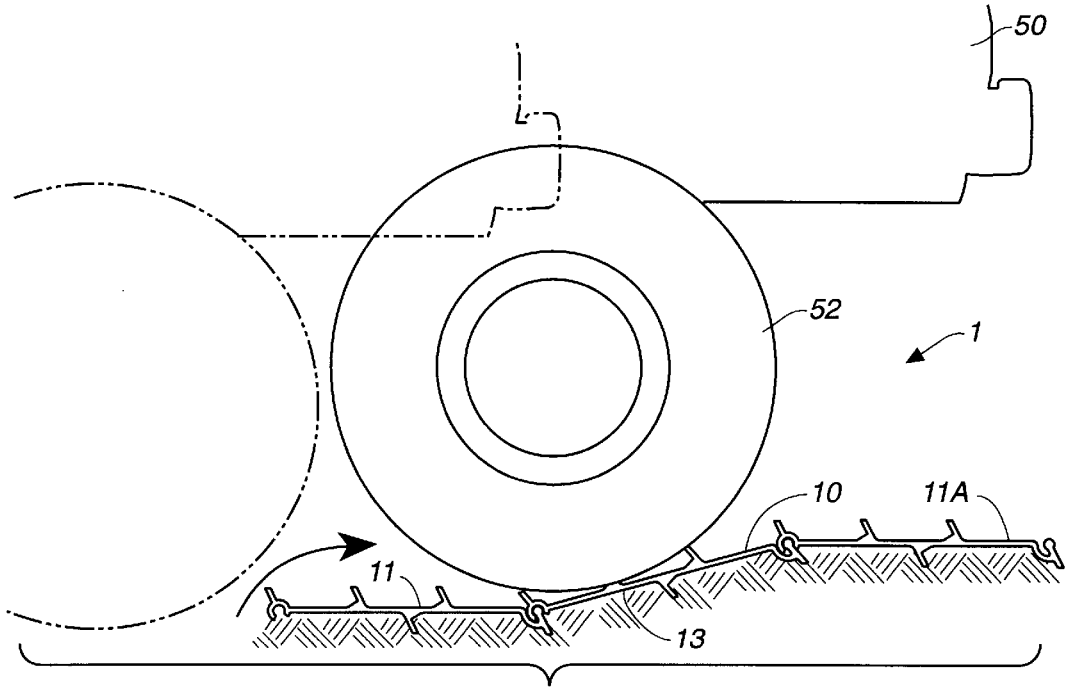
FIG. 3 is a schematic frontal elevation illustrating utilization of the apparatus of FIG. 1 to extract a vehicle from a rut.
Figure 2:
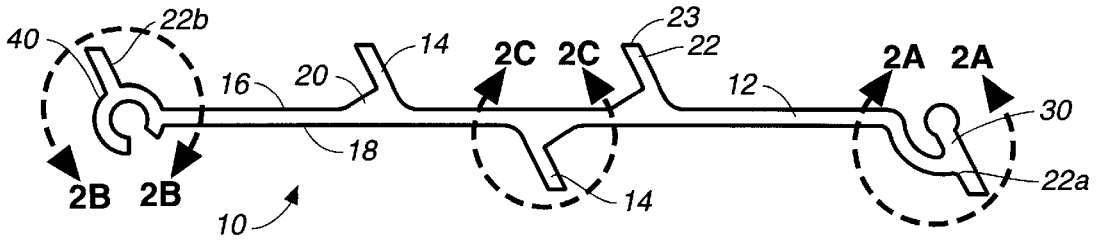
FIG. 2 is a frontal elevation of an individual traction plate device of the apparatus of FIG. 1.
Figure 1A:
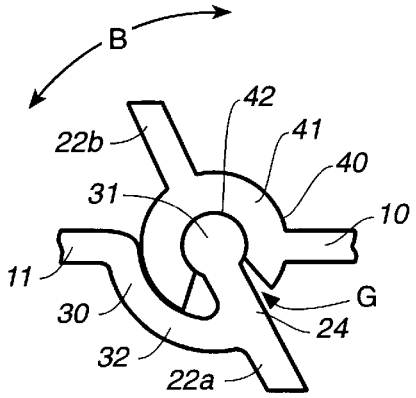
FIG. 1A is a broken detail view of the interlocked ends of the traction plate devices forming the apparatus of FIG. 1.

Referring to FIGS. 1A and 2B, the arc C that bounds gap G is from 20° to 40° in extent, preferably 30°. Arc D takes the distal edge of the gap G out another 15° beyond angle A (about 65°). Note that the gap G is considerably wider than the neck 24 of the terminal gripping beam 22*a* (preferably about twice as wide) so that the traction plate devices 10, 11 may rotate freely with respect to each other along the arc of arrow B. Turning next to FIG. 3, it can be seen that this degree of rotational freedom (together with the short length of individual traction plate segments) allows the traction apparatus 1, comprised of an assembly of such articulated barred traction plates, to conform to the bottom profile of the rut 13 in which the wheel 52 of a vehicle 50 is entrapped, and to the ground surface immediately adjacent to the rut. This prevents overly broad voids from forming under any one traction plate device 10, 11, 11A. Otherwise, the weight of the vehicle might tend to collapse the elongated body plate 12 into such voids.

The above disclosure is sufficient to enable one of ordinary skill in the art to practice the invention, and provides the best mode of practicing the invention presently contemplated by the inventors. While there is provided herein a full and complete disclosure of the preferred embodiments of this invention, various modifications, alternative constructions, and equivalents may be employed without departing from the true spirit and scope of the invention. Such changes might involve alternative materials, components, structural arrangements, sizes, operational features or the like.

For example, the traction plates device 10, 11, etc. of traction apparatus 1 preferably are formed of lightweight metal or rigid plastic by extrusion or molding, rather than by welding. In such cases, the support members 20 of the gripping beams 22 normally will be solid, as drawn, rather than hollow. However, such support members could be hollow, as previously taught in the art, to save weight.

As noted above, a special traction plate could be provided within a set of plates, the special plate having the female (or male) hinge member end removed so that a flat edge of the body plate 12 would be available to be slid under a trapped wheel.

The orientation in which the apparatus is laid within a rut readily may be reversed from left to right (when compared with the orientation shown in FIG. 3) should such a reversal improve either the traction of the wheel against the upper gripping beams or the traction of the lower gripping beams against the ground.

Therefore, the above description and illustrations should not be construed as limiting the scope of the invention, which is defined by the appended claims.

What is claimed is:

1. Vehicle wheel traction plate apparatus including:

a planar elongated body plate;

a plurality of transverse gripping beams attached to the upper surface and to the lower surface of the body plate; and a rotatable hinge member at each end of the body plate for interlocking a plurality of body plates together, at least one gripping beam attached to said hinge member at one end of the body plate and extending above the upper surface of the body plate, and at least another gripping beam attached to said hinge member at the other end of the body plate and extending below the lower surface of the body plate.

2. The apparatus of claim 1 wherein: said rotatable hinge members at the ends of the body plate constitute first and second hinge members.

3. The apparatus of claim 2 further including:

a transverse cylindrical bead on the first hinge member; and a transverse open-sided cylindrical channel formed on the second hinge member, the channel being generally congruent in shape and of slightly larger diameter when compared to the cylindrical bead.

4. The apparatus of claim 3 wherein:

the open side of the channel forms an arcuate gap of from 20 to 40 degrees in extent.

5. The apparatus of claim 3 further including:

free ends of the gripping beams outward of the body plate; and top surfaces on the free ends of those of the gripping beams that are attached to the upper surface of the body plate, the top surfaces all lying in a plane that is parallel to the plane of the body plate.

6. The apparatus of claim 3 wherein:

the gripping beams are planar, each of whose planes intersect the plane of the body plate at an angle of from 55 to 75 degrees.

7. Vehicle wheel traction plate apparatus including:

a planar elongated body plate;

a plurality of transverse gripping beams attached to the upper surface and to the lower surface of the body plate;

means for interlocking a plurality of body plates together;

first and second hinge members of the interlocking means, one on each of two opposite ends of the body plate;

a transverse cylindrical bead on the first hinge member;

a transverse open-sided cylindrical channel formed on the second hinge member, the channel being generally congruent in shape and of slightly larger diameter when compared to the cylindrical bead; and a gripping beam on the cylindrical bead.

8. Vehicle wheel traction apparatus including:

a plurality of planar elongated body plates;

a plurality of inclined transverse gripping beams attached to the upper surface and to the lower surface of each body plate; and rotatable hinge means for interlocking the plurality of body plates together at least two gripping beams attached to opposite sides of the rotatable hinge means.

9. The apparatus of claim 8 wherein:

the rotatable hinge means includes first and second hinge members, one on each of two opposite ends of at least one body plate.

10. Vehicle wheel traction apparatus including:

a plurality of planar elongated body plates;

a plurality of inclined transverse gripping beams attached to the upper surface and to the lower surface of each body plate;

hinge means for interlocking the plurality of body plates together;

first and second hinge members of the interlocking hinge means, one on each of two opposite ends of at least one body plate;

a transverse cylindrical bead on the first hinge member, the first hinge member having a first hinge member projecting gripping beam; and a transverse open-sided cylindrical channel formed on the second hinge member, the channel being generally congruent in shape and of slightly larger diameter when compared to the cylindrical bead, the second hinge member having a second hinge member projecting gripping beam, the first hinge member gripping beam projecting from one of the upper and lower surfaces of the body plate and the second hinge member gripping beam projecting from the other of the upper and lower surfaces of the body plate.

11. The apparatus of claim 10 wherein:

the open side of the channel forms an arcuate gap of about 30 degrees in extent.

12. The apparatus of claim 11 further including:

free ends of the gripping beams outward of the body plate; and top surfaces on the free ends of those of the gripping beams that are attached to the upper surface of each body plate, the top surfaces all lying in a plane that is parallel to the plane of their associated body plate.

13. The apparatus of claim 12 wherein:

the gripping beams are planar, each of whose planes intersect the plane of the body plate to which they are attached at an angle of about 65 degrees.

* * * * *